United States Patent [19]

Blach

[11] 4,387,112

[45] Jun. 7, 1983

[54] ARTICLE IDENTIFICATION PROCESS AND ARTICLES FOR PRACTICE THEREOF

[76] Inventor: Rodney J. Blach, P.O. Box 7911, Mountain View, Calif. 94039

[21] Appl. No.: 199,964

[22] Filed: Oct. 23, 1980

[51] Int. Cl.[3] ..... B44F 1/12

[52] U.S. Cl. ..... 427/7; 283/92; 283/901; 427/54.1; 427/56.1; 427/157; 436/56

[58] Field of Search ..... 427/7, 157, 56.1, 54.1; 283/9 R

[56] References Cited

U.S. PATENT DOCUMENTS

| | | | |
|---|---|---|---|
| Re. 29,334 | 8/1977 | Ryan et al. | 427/157 X |
| 2,848,348 | 8/1958 | McCafferty | 427/7 X |
| 3,679,448 | 7/1972 | Tramposch | 427/7 X |
| 3,775,173 | 11/1973 | Yamamoto et al. | 252/62.3 X |
| 4,197,104 | 4/1980 | Krystyniak et al. | 65/21 |

FOREIGN PATENT DOCUMENTS

| | | | |
|---|---|---|---|
| 207503 | 4/1957 | Australia | 427/157 |
| 486999 | 10/1952 | Canada | 427/157 |

OTHER PUBLICATIONS

Leverenz, *Luminescence of Solids*, publ. Wiley & Sons, N.Y., 1950, Table V.

Leverenz, H. W. *An Introduction to Luminescence of Solids*, Dover Publ., 1968, pp. 150, 151, 180–183.

*Primary Examiner*—Michael R. Lusignan
*Assistant Examiner*—Janyce A. Bell
*Attorney, Agent, or Firm*—Willis E. Higgins

[57] ABSTRACT

Ordinary articles involved in transactions that require ascertaining authenticity of the article, such as wearing apparel, electronic parts, identification cards, or credit cards, may be identified as genuine through use of stimulatable inorganic phosphor compositions. The inorganic phosphors are applied to the article to be identified. The phosphors are excited to store energy therein, such as excitation by application of light as in a radiative photon process, or by application of thermal or electric fields as in a conductive process. The storage may be for however short or long a period. The result of storage is a later emission of real—time luminescence, sometimes called fluorescence, or of time-lag luminescence, sometimes called phosphorescence, or of no luminescence, where energy is either totally stored, converted to non-visible emissions such as infrared radiation, or internal conversion processed. The phosphors with stored energy as a result of this excitation are then stimulated during or after the excitation. The stimulation may be by use of light as in a radiative photon process, or by use of thermal or electric fields as in a conductive process. A change in emission of radiant energy from the phosphor as a result of the stimulation, such as change of luminescence of the phosphor, is then observed to verify the presence of the inorganic phosphor in the article. Such inorganic phosphors provide positive identification of the article because their behavior under the process steps above cannot be mimicked with organic compounds, and preparation of such inorganic phosphors, or phosphors capable of mimicking individual observed phenomena of the bona fide phosphor, especially preferred intermediate converter mixed phosphor type, is beyond the capability of counterfeiters. The behavior of such phosphors in response to the above process steps is also easily recognizable visually without use of complex analytical apparatus, thus providing an ideal forensic test.

25 Claims, No Drawings

ARTICLE IDENTIFICATION PROCESS AND ARTICLES FOR PRACTICE THEREOF

BACKGROUND OF THE INVENTION

1. Field of the Invention

This invention relates to an article identifying process. More particularly, it relates to such a process which is immune to counterfeiting. It further relates to such a process which will allow the path of genuine articles with which the process is used to be traced in distribution channels of commerce.

2. Description of the Prior Art

A variety of techniques are known in the prior art for identifying articles in an effort to reduce counterfeiting of them. The use of trademarks, special labels, serial numbers and similar practices is well known. However, such techniques are often subject to counterfeiting, particularly in the case of articles for which demand exceeds supply. Such a supply and demand imbalance may be the result of ordinary market conditions, such as in the case of integrated circuits. The imbalance may also be artificially produced by the manufacturer of the articles, such as in the case of designer label wearing apparel, in order to allow higher profit margins. In either event, there is substantial incentive for counterfeiters to take advantage of the supply and demand imbalance. A related problem is the theft and subsequent distribution of genuine articles for which the demand exceeds the supply. Similar considerations apply in the case of credit cards and identification cards.

A further approach which is often employed in an effort to reduce such counterfeiting is to apply certain fluorescent or phosphorescent materials to the articles, either in a predetermined pattern, or simply by impregnating the article or a portion of the article with the fluorescent or phosphorescent materials. Such materials are not ordinarily visible, but if, for example, an ultraviolet light is shined on them, they exhibit their fluorescence or phosphorescence. Such materials may be either organic or inorganic compounds or compositions, with organic phosphorescence (when present) being very short-lived. The use of inorganic fluorescent or phosphorescent materials is preferred because these materials are harder for counterfeiters to duplicate. Organic fluorescent or phosphorescent materials are usually more easily synthesized by a typical counterfeiter of limited resources and technical sophistication.

However, only limited success has been attained in this regard, even with the use of more difficult to obtain inorganic fluorescent and phosphorescent materials.

While both organic and inorganic materials and capable of having their fluorescence or phosphorescence modified in spectral wavelength, intensity and time behavior, greater variation of emission behavior is possible with the inorganic materials. Organic material fluorescence and phosphorescence occur as a result of molecular bonds, especially pi bonds, being activated by excitation to storage of energy followed by emission. No long term, time-lag, storage based emission is possible at room temperature since the organic material cannot interact sufficiently with crystal lattice elements (or other proximal rigid structures) in the vicinity of its molecular bonds to produce a storage capacity. For this reason, time-dependent, storage based emission behavior of organic materials does not extend beyond mere minute fractions of a second duration.

In contrast, inorganic material fluorescence and phosphorescence occur as a result of molecular orbital electron interaction with the surrounding lattice elements to produce time-dependent, storage based emission behavior lasting, in some instances, even indefinitely.

The ready availability or ease of manufacture of organic materials has been matched by analogous ready availability or ease of manufacture of many inorganic phosphor materials. Since these organic and inorganic materials can be procured or manufactured, and used to mimic the behavior of state-of-the-art compositions in prior art identification techniques, counterfeiting has continued. Only when difficult to procure or manufacture proprietary compositions are used, whose complex stimulated behavior is as described herein as sequential process or step testing for excitation, storage and emission behavior, and which cannot be mimicked by off-the-shelf compositions, will counterfeiting stop.

To devise a counterfeit-proof identification process, it is also instructive to consider previous sucesses with paper substrate objects, such as currency and checks. The integrity of currency is protected by the presence of images that defy counterfeiting. The U.S. Treasury Department produces currency using expensive printing presses, high technology, such as engraved plates, special papers, and special formulation inks. A controlled source of supply is maintained both for the ink and the paper. The currency example shows that a successful counterfeit resistant system has control points in manufacture, through equipment, technology and supplies that are beyond the financial and technical resources of the counterfeiter.

Transference of the currency approach to non-paper-based objects has generally failed. Extraordinary unit costs of production and the nature of the finely detailed images to be printed prohibit the assembly line manufacture of non-paper-based objects with a counterfeit resistant image comparable to that employed with currency.

It is further recognized that an article identifying process must meet the rigorous standards of forensic science if it is to be useful in practice. What is sought, as an additional result of this invention, is to mesh civilian and police investigations of authenticity with the goal of providing a forensically viable identification method acceptable to prosecution, preferably interchangeably, in both civil and criminal courts. An important consideration is therefore that the process must give a clear, unambiguous result. An ideal process further must involve a simple test procedure that persons without scientific training, such as store clerks, security guards and police, can administer without getting either false positive or false negative results. Only such tests will be usable on a widespread basis outside a laboratory setting and still be accepted for evidentiary purposes in criminal and other legal proceedings.

SUMMARY OF THE INVENTION

Accordingly, it is an object of this invention to provide a process for identifying ordinary articles involved in transactions that require ascertaining authenticity, which process is immune to counterfeiting.

It is another object of the invention to provide such an identification process which meets the standards of forensic science.

It is a further object of the invention to provide such an identification process which does not change the appearance of the article except when the identification process is carried out.

It is still another object of the invention to provide a process for both identifying an article as genuine and for tracing the distribution of the article, which process is immune to counterfeiting.

The attainment of the foregoing and related objects may be achieved through use of the novel article identification process and articles treated for practice of the process herein disclosed. Fundamentally, the identification process of this invention relies on the use of stimulatable inorganic phosphor compositions in a multiple step process.

As used herein, the term "stimulatable inorganic phosphor" refers to such materials which exhibit a change in their emission of radiant energy when certain types of energy are supplied to them during or after they have been excited to store energy in them. Such as additional testing step should be contrasted with current state-of-the-art whereby emission, without stimulation induced behavior modification of emission characteristics, is produced as an identification test of authenticity. Excitation and stimulation of the phosphors are by definition distinguished by the purpose of the imposed incident energy. Excitation causes energy to be stored, for however short or long a time period, in expectation of a later potential discharge. Stimulation is the application of energy to affect the discharge of this stored energy in a manner recognizable as a change from whatever ongoing spontaneous discharge processes are occurring. This change, for example, may manifest as an increase or decrease of discharge, or a shift in the energy level distribution of discharge emissions.

The process of this invention for identifying an article is carried out by first applying a stimulatable inorganic phosphor to the article. The phosphor is excited, typically by radiant energy, to store energy in it. During or after excitation, the phosphor is then stimulated. The change in emission of radiant energy from the phosphor as a result of the stimulation is then observed to verify the presence of the inorganic phosphor in the article. Such stimulatable inorganic phosphors are used in the identification process of this invention because they are sufficiently difficult to prepare so that they are available from only a few technically sophisticated companies. Also, the particular observable change in emission of radiant energy as a result of the stimulation varies with the composition of the stimulatable inorganic phosphor, so that compositions having no other use than in the process of this invention may be provided. Further, since the change in emission of radiant energy from such stimulatable phosphors relates to their crystal structure, such changes cannot be mimicked with an easily synthesized organic compound.

The attainment of the foregoing and related objects, advantages and features of the invention should be more readily apparent to those skilled in the art after a review of the following more detailed description of the invention.

DETAILED DESCRIPTION OF THE INVENTION

To understand how phosphors are to be used in this invention, the phosphors need to be classified according to their peculiarities in excitation, energy storage, stimulation and emission behavior. A phosphor usually is capable of all four actions in various sequenced steps.

The inorganic phosphors used in the process of this invention are substances that can absorb energy in any of the ways traditionally described as energy transfers in physics. One broad category of these energy transfers is radiation, which can involve alpha or beta radiation, neutron, proton, electron, pion, muon transfer, atomic particulates, and photons, i.e., "light." Another broad class of such energy transfers encompasses conduction, which may be thermal, electric, or magnetic induced electric.

A substance is defined for purposes of this invention as a phosphor if it can absorb excitation energy from one of the above energy sources, store the energy for however short or long a period, and then emit the energy through any process that by definition discharges the stored energy. A preferred form of emission is luminescence, a radiative process yielding light here defined as wavelengths above 2.7 microns (approximately one-half electron volt energy), although longer wavelength light, or internal conversion processes for discharging the stored energy are also acceptable. Internal conversion of the stored energy is usually expressed in molecular kinetic, rotational or vibrational energy retained in these phosphors.

As explained earlier, excitation and stimulation of the phosphors are by definition distinguished by the intent of the imposed incident energy. Excitation causes energy to be stored, for however short or long a time period, in expectation of a later potential discharge. Stimulation is the intentional application of energy to affect the discharge of this stored energy in a manner recognizable as a change from whatever ongoing spontaneous discharge processes are occurring. This change, for example, may manifest as an increase or decrease of discharge, or a shift in the energy level distribution of discharge emissions.

Phosphors can be classified on several levels according to the relationship between absorption and emission wavelengths or energies. Stokes Law, first postulated about the year 1852, states that phosphors absorb energy and emit at a less energetic, longer wavelength. This phosphor type can be called a down converter based on this functional definition. These are the most common phosphors, and laymen visualize these types when asked to describe how a phosphor behaves.

Those knowledgeable in the art, though, recognize that Stokes Law has been informally rewritten in this century to accommodate multiphoton absorption capable of producing wavelengths of higher energy than individual absorbed photons. The revised Stokes Law can be paraphrased as: The energy sum absorbed by a single storage entity can result in an emission of one or more photons each of which has an energy less than the initial energy sum absorbed and more or less than any single photon absorbed. These phosphors are commonly called up converters when an electron will absorb two or more lower energy photons to produce a high energy photon. Such phosphors are taught in, for example, Sarver et al, U.S. Pat. No. 3,580,860; Geusic et al, U.S. Pat. No. 3,593,055; Geusic et al U.S. Pat. No. 3,654,463 and Otomo et al, U.S. Pat. No. 3,767,588. In the special case where two or more photons are absorbed and produce a photon of energy lower than any absorbed photon, the phosphor classification reduces to a common down converter.

The technology of up and down converters, and their receptivity to stimulation as covered in this patent application, can be demonstrated by example with light wavelengths in the ultraviolet to near infrared range. The most general description of a phosphor's light energy absorption can be revealed by a plot of absorption versus wavelength or energy level (absorption spectra). The absorption occurs through the various absorption bands revealed in the spectra plot. Each band contains a group of wavelengths able to induce the same effects in the phosphor. Usually several classes or groups of such bands exist in the absorption spectra of the phosphor. The highest energy band or set of bands are usually the excitation bands. The next lower band or set of bands are typically quench bands able to decrease the intensity of any excitation based emission. The lowest band or set of bands are typically intensifier bands. It has been hypothesized that these bands act by discharging the stored excitation energy. The quench and intensifier absorptions therefore stimulate the emission process, sometimes even with both processes occurring at the same wavelengths if the lowest levels of absorption of each are considered.

When the phosphor absorbs one or more photons (multiphoton absorption by a single charged entity) in a single band or group of close bands known to cause emission, the phosphor is called an up converter if the emission is of higher energy than any of the absorbed photons. A down converter phosphor has the emission of lower energy than any of the absorbed photons. An up converter, for example, can produce visible light from infrared light. A down converter, for example, can produce infrared or thermal emissions from visible or ultraviolet light.

When the phosphor absorbs, in addition to a higher energy excitation photon, a lower energy photon from one of the quench or intensifier bands to act upon the exciter storage function, the phosphor is said to be in a stimulated condition as defined in this invention. Such a phosphor shall be called an intermediate converter, and is able to produce emissions of higher or lower energy than the absorbed stimulant. The invention's preferred embodiment is intermediate converter phosphor production of wavelengths of higher energy than the stimulating energy. Such phosphors are taught in, for example, Miller, U.S. Pat. No. 2,521,124 and Urbach, U.S. Pat. No. 2,522,074.

Typically, up converters have real-time emissions. As soon as the absorption pumping energy into the system stops, so does emission. Usually no energy storage entities are elevated in energy without addition of energy into the system. The intermediate and down converters typically are capable of both real-time and time-dependent emissions.

In summary of this classification scheme, the following Stoke's type rule of phosphor absorption and emissions behavior can be made: The absorption of one photon or energy unit by a single storage function entity can result in only a lower energy emission unless the absorption of one or more additional photons by the already excited entity intervenes through up converter processes.

The practical application of intermediate converter stimulation to all phosphors, regardless of the number of photons absorbed by a single entity, means stimulation based multiphoton behavior can provide the basis for a test to identify phosphors. During or after phosphor excitation to emission, the stored excitation energy luminescence discharge phenomena can be multiphoton stimulated to altered luminescence by careful choice of suitable stimulation wavelengths. The resultant changes are characteristic of the phosphor and its lattice.

Another observation on phosphor multiphoton absorption processes is in order. In the special case where conduction induced (thermal or electric field) stimulation results in emission, the additional absorbed photon or energy unit may also act upon the lattice to lower lattice energy states relative to the charged energy states. The energy level of a charged entity is always relative to the energy level of lattice forces trapping that charged entity. A change in the energy of either one has the effect of increasing or decreasing the difference between them. Sufficient increased charged entity energy over trapping forces in the lattice usually leads to emission.

Since stimulation is intentional initiation of a multiphoton process, a process central to this invention, the effects of stimulation need elaboration. Here multiphoton processes acting upon the storage capacities of the phosphor usually transfer discrete packets of energy, since the transfer process involves particles of molecular and atomic dimensions. Therefore, the term multiphoton stimulation applies to both radiative and conductive absorption processes in their absorption mechanism.

The stimulation energy for the purposes of this invention may be obtained from the same type of energy sources described above for exciting the phosphor. Just as with excitation, stimulation processes require an energy transfer, implying a storage function of stimulation energy. A short or long stimulation energy storage period for individual absorptions implies real or delayed resulting emission respectively. However defined, stimulation applied during or after excitation induces a discharge of stored excitation energy. The stimulation energy level is equal to or lower than the excitation energy level. The final stimulated emission will always be lower in energy than the excitation energy sum stored in a charged entity. These emission rules follow the intent of the modified Stokes Law rule previously elaborated. The preferred emission due to stimulation is of an energy level higher than the stimulation absorption.

The stimulation segment of the multiphoton absorption process can lead to either emission, preferably visible luminescence, or internal conversion. When the stimulation process energy discharge is superimposed on either real time or delayed time spontaneous emission processes due to excitation, fluroescence and phosphorescence respectively, the result is a competition for stored excitation energy discharge. The dynamics of the competition usually call for fluorescence or phosphorescence to be modified in intensity. If the intensity of stimulating energy is sufficiently high, discharge of stored energy by stimulation can swamp the fluroescence or phosphorescence discharge of stored energy to the effect that stored excitation energy is diverted to the stimulating process. This diversion may easily be so overwhelming that fluorescence and phosphorescence emissions may cease altogether, whereby the fluorescence and phosphorescence spectra may be supplanted by a stimulated emission spectra.

In the instance where stimulation yields visible luminescence, the luminescence spectra most likely will not exactly coincide with the fluorescence of phosphorescence spectra. The result of stimulation in the multiphoton absorption process can then be said to be reduction or elimination, in whole or in part, of fluorescence and/or phosphorescence spectra intensities, and the emergence of a new spectra "color" of likely different intensity.

In the instance where stimulated emission yields internal conversion, no luminescence is produced. The result of stimulation in the multiphoton absorption process is the reduction or elimination of fluorescence or phosphorescence spectra intensities, and no new spectra. Such a reduction of elimination of fluorescence of phosphorescence is referred to as "quenching," and preferably should yield a dramatic change in emission to serve as a reliable indicator of the presence of the inorganic phosphor.

It should be recognized that one or more levels of stimulation energy may be concurrently or consecutively acting through the multiphoton absorption process. The usual example would be radiant versus conductive stimulation processes of imparting stimulation energy to a phosphor. The conductive class of stimulation energies include thermal, magnetic and electric energies. Each of these classes of conductive energy is capable of stimulating its own multiphoton absorption emission in addition to whatever is occurring with radiative stimulation energies. The net result is a competition for stored excitation energy between radiative and conductive stimulation. The induction of sufficient thermal, magnetic or electric fields in the phosphor can so divert to luminescence or internal conversion (quenching) the stored excitation energy that radiant based emissions can altogether stop.

The preferred examples of stimulatable inorganic phosphors suitable for use in constructing a counterfeit-proof label or other means of identifying an article is found in the class of phosphors called infrared stimulatable mixed phosphors. These phosphors presently have little or no commercial use, hence represent a potential for restrioting supply to counterfeiters. Their infrared stimulatability means that infrared radiation, which the eye cannot see, will not interfere with the eye's perception of luminescence discharge in the visible spectrum. These phosphors are called "mixed" because they have, alternatively, two different trace ion activators, two different phosphor lattice cations, or two different phosphor lattic anions. Suitable infrared stimulatable mixed phosphors are exemplified but not limited to the following phosphors made from the following lattice cations with Group VI anions:

| | | |
|---|---|---|
| SrS (Ce,Sm) | Zn, Cd S (Cu) | CdS, Se (Cu) |
| SrS (Sm,Bi) | | SrS, O (Eu,Sm) |
| SrSe (Eu,Sm) | | |
| ZnS (Pb,Cu) | | |

Techniques for preparing these infrared stimulatable mixed phosphors in a finely divided form, thus allowing their ready incorporation in fibers for a wearing apparel label or inks for printing on an article to be identified are known in the art, as disclosed in, for example, the above referenced U.S. Pat. No. 2,552,074 and 2,521,124. These phosphors, in finely divided form, are preferably incorporated in a polymer matrix, such as triacetate, acrylate or polyurethane resin. A further refinement would be use of resins or other polymers able to withstand thermal or electrical degradative processes of stimulation, as taught in U.S. Pat. No. 3,591,283 (Peisach). The polymer matrix containing the phosphor is then used to impregnate the label fibers either in any manner or in a desired pattern as a code to indicate, for example, the supplier to which the goods are furnished as well as the authenticity of the article. If used in an ink for marking an article, such as an integrated circuit or other electronic part, the ink is usually applied in the form of an identifying code.

In practice of the process of this invention with these phosphors, they are first excited with ultraviolet or visible light substantially free of infrared radiation to store energy in them. This source of light is typically a fluorescent light bulb, a noble gas glow tube, or a noble gas flash tube. The phosphors, during or after excitation, are then stimulated with infrared radiation in a low ambient light level environment. With the preferred luminescence type stimulatable inorganic phosphors, a visible spectrum is usually emitted upon stimulation.

These phosphors offer a wide latitude of potentially different visible wavelength emission spectra. Changing the activator or activator pair is one way of changing spectra. Another way is to change the concentration of the lesser concentration cation component in the phosphor lattice. This will produce a shift of spectra to shorter or longer wavelengths. So long as the concentration of the lesser cation component is capable of forming mixed crystals with the greater cation component, the spectrum can be shifted smoothly in that concentration range. Each of these mixed phosphors has a fluorescent and a phosphorescent spectrum. If visible, and most or all are, these spectra may serve to further distinguish among infrared stimulatable phosphors whose stimulated emission spectra are alike.

These mixed phosphors have other desirable properties. Depending upon concentration of components, the storage of excitation energy may be prolonged by the phosphor's self-inhibition of phosphorescence. This allows a prolongation of the period between excitation and stimulation, so as to make stimulation initiation reasonably independent of time lapse since excitation, which is a desirable feature for a forensic test. An example of a mixed phosphor of this type is the strontium sulfide matrix, activated by the europium-samarium pair. Its stimulation emission spectra has a characteristic orange-red color. Another desirable property possible in mixed phosphors is the increased storage capacity for excitation energy. The absorption and storage of a large amount of excitation energy coupled with self-inhibition of phosphorescence means a higher degree of time independence for the initiation of a later stimulation process.

It should be noted that the preferred mixed phosphors for practice of this invention also usually have thermal or electrical stimulation potential capable of producing or modifying emission processes as described earlier for phosphors. The stimulation of thermal radiation or thermal conduction during or after phosphor excitation will generate a glow spectrum or terminate emission. The passage of an electric, or magnetic induced electric, field through the excited phosphor causes a change of energy state of charged entities within the phosphor. The entity will move from a state of high energy potential, representing stored excitation energy, to a lower energy potential, yielding emissions, preferably visible light, in the process. Such emissions are usually characteristic of one or both activators in an activator pair, or of the sole activator if only one activator is used.

The following non-limiting example represents a preferred mode for practicing the process of this invention and serves to describe the invention further.

This example illustrates broadly the potential of phosphors, especially phosphors exhibiting time dependent emissions (phosphorescence), for use in security markings. These phosphors will be illustrated in the context of a forensic test.

The phosphor is SrS (Eu,Sm). This phosphor's main lattice component is strontium sulfide. Usually sulfate and oxide anions are present in the manufacture of the phosphor, hence may be present as is or in modified form in the final product. The manufacture is described in the above referenced U.S. Pat. Nos. 2,522,074 and 2,521,124.

As a preferred embodiment, it is desirable to have other cations and anions able to form mixed crystals, such as calcium or oxygen, present for reasons described earlier, but for now the simplified example shall be SrS (Eu,Sm) without other anions or cations present in the lattice. The phosphor has two activators. Europium is the dominant activator, Samarium the auxiliary activator.

An unexcited SrS (EU,Sm) phosphor has a strong narrow absorption band centered at 480 nm wavelength (blue). This band leads to storage of excitation energy. As excitation and energy storage continues, new excitation absorption bands appear at approximately 600 nm (orange) and 1000 nm (near infrared). The intensity of these bands increases as the storage of the 480 nm excitation energy increases. During this process the 480 nm absorption band proportionally decreases until saturation with energy is approached. The dominant activator, Eu, is the cause of these absorption bands.

The absorption band at 600 nm (orange) is a typical quenching absorption band of shorter wavelength than the intensifier absorption band at 1000 nm. If the phosphor is irradiated with both 480 nm (blue) and 600 nm (orange), the orange will typically discharge the energy storage process. Because the 480 nm band is so intense compared to the 600 nm band which only develops upon storage of excitation energy, an excitation-quenching equilibrium typically occurs greatly to the benefit of storage of high amounts of excitation energy. The absorption band at 1000 nm coincides with the primary absorption band of Samarium which is centered at about 1000 nm. This auxiliary activator has its own absorption bands, but the significant feature of the Sm absorption band at 1000 nm is the coincidence factor.

Apparently the excitation of Eu at 480 nm causes the storage of energy in both Eu and Sm. This phosphor pair are mutual phosphorescence inhibitors. As soon as excitation ceases, a mutual inhibition of discharge occurs to such a degree that phosphorescence drops one or more levels of magnitude below the phosphorescence intensity possible with a single activator. To the photoptic (light adapted) human eye, phosphorescence ceases after a few seconds. Once a stable discharge at the lower levels of phosphorescence occurs (after five or ten seconds), the stored energy discharge rate will typically be less than 1% per second.

The use of an activator pair such as this Eu-Sm pair leads to interesting and desirable features in a lattice such as SrS, that would not be possible using either activator alone:

greatly increased energy storage
depressed discharge levels
induced infrared stimulation sensitivity The last feature is so desirable because Europium activator alone is relatively insensitive to infrared stimulation of emission even though a reasonably strong absorption band in the infrared (1000 nm) develops upon energy storage.

A mixed phosphor such as the SrS (Eu,Sm) described has exceptional utility as the basis for a forensic test because of the three features listed. A good forensic test that depends upon a test sequence should have the timing of steps beyond the first action reasonably independent of time lapse. In this manner consistency of results is achieved that does not require a learning period or force a subjective evaluation of the test result validity. The very large light storage and very small spontaneous discharge of the light storage confers the time independence of stimulations performed after the initial excitation step, and confers a larger differential increase upon stimulation than possible without these two properties.

Phosphors of the SrS type have another interesting property. They are capable of electrophoto-luminescence. The excitation energy stored for phosphorescence can be further discharged during fluroescent or phosphorescent processes by a strong electric field. The field can be imposed across phosphor grains (or across high dielectric matrices holding the phosphor grains) with the result that luminescence occurs. This emission can identify either or both activators, depending upon the phosphor's composition. Typical electric field strengths are 1,000–10,000 volts per centimeter. A field of 100 volts across electrodes spaced at 100 microns distance is reasonably equivalent to the voltages suggested for a centimeter spacing.

It is typically the process of imposing the voltage field that causes the luminance, so whether a DC field or a slowly varying AC field is imposed across a phosphor composition, luminescence occurs. The varying field usually produces a continued luminescence of variable but high intensity.

Since the class of sulfide phosphors is notoriously efficient in producing the above electrophotoluminescence effects either during or after excitation (fluorescence or phosphorescence) it is an expected feature of SrS (Eu,Sm) that electric field production of luminescence can be used to identify either or both of the activators by their characteristic spectral emissions. Since this phenomenon increases with increasing electric fields, even if the SrS (Eu,Sm) were a weak emitter under electric field stimulation, a sufficiently strong electric field can elicit a photoptically visible response.

Phosphors in general have another desirable property, the SrS (Eu,Sm) phosphor included. The property is called thermophotoluminescence.

In this phenomena, the stored excitation energy absorbed at 480 nm can be discharged as a photoptically visible glow once a particular thermal conduction induced, phosphor temperature range is reached. The exceptional storage function of the SrS (Eu,Sm) phosphor is possible because room temperature is so far below this thermophotoluminance point for SrS (Eu,Sm). Typically this point for a SrS mixed phosphor manufactured as described may be 300°–400° C.

The forensic test enabling the tester to identify the phosphor, and hence the authenticity of an article of transfer, will be composed as follows for SrS (Eu,Sm); photoptically visible emissions are to be expected, so human eye light adaption shall be designated as that typical of a retail establishment's ambient light levels.

1. An intense light overlapping the phosphor excitation band at 480 nm is applied to a phosphor containing composition so as to excite the phosphor to a high level of excitation energy storage.

2. The excitation light is terminated, and an observation made for the rapid decay of phosphorescence to the low levels typical of this phosphor.
3. An intense infrared light overlapping the phosphor stimulation band at 1000 nm, but not to include visible light is applied anytime after a reasonable time lapse, from seconds to minutes, after excitation has terminated. Stimulation emission is observed.
4. An electric field of appropriate strength is applied to the phosphor composition so as to cause electrophotoluminescence. Alternatively, a thermal infrared emission (of high intensity preferably) or a thermal conduction is effected to produce a thermophotoluminescence. These electro- or thermo-effects can be applied during or after step 3 to produce stimulation emission to be observed.

For a SrS (Eu,Sm) phosphor, step 3 yields an orange emission typical of Europium, while step 4 yields an orange (Eu), yellow (Sm), or orange-yellow (Eu-Sm) emission as formulated to occur.

The steps enumerated will presumptively identify (via coincident testing theory) the phosphor as SrS (Eu,Sm), and conclusively identify the phosphor as being of the class: infrared stimulatable mixed phosphors. The authenticity of the article of transfer will then be confirmed.

The step 3, step 4 and steps 1–4 series identify the dominant Eu activator, the auxiliary Sm activator, and the phosphor lattice respectively.

In retrospect, the only practical way the steps 1–4 can be faked by substitution of a non-bona fide material is through incorporation in the security composition of:

1. A suitable down converter Stoke's Law phosphor sensitive to blue light and possessing a low level of phosphorescence decay.
2. A suitable up converter anti-Stoke's Law phosphor sensitive to infrared light able to yield the correct excited fluorescence spectral emission.
3. Both the above phosphors, each capable of emitting correct spectra upon induction of conductive stimulation to identify activators as necessary.

This process of producing a fake is so extraordinarily difficult that a counterfeiter with the resources to do so would seek to duplicate the bona fide phosphor (fake phosphors as above are as difficult to procure as the bona fide phosphor). Since that phosphor is a proprietary composition requiring high technology, it is expected that counterfeiting of the article of transfer would be totally suppressed. The counterfeiter then can turn his attention to counterfeiting competitors' goods not protected by the phosphor composition.

It should now be apparent to those skilled in the art that a novel process for the identification of articles of transfer capable of achieving the stated objects of the invention has been provided. Because the process of this invention utilizes stimulatable inorganic phosphors whose stimulation radiation energy emission characteristics cannot be mimicked with organic compounds or mixtures of readily obtainable inorganic compounds, and because supplies of particular stimulatable inorganic phosphor compositions employed for practice of this invention can be readily controlled, counterfeiting is made much more difficult through use of this process. Especially, when the preferred phosphors exhibiting luminescene changes on stimulation are employed, in particular the preferred phosphors whose stimulated emissions are of higher energy than the stimulating energy, an unambiguous, easily performed test is provided, thus meeting the requirements of forensic science. Further, the test results are observable with the unaided human eye, so that the verification process of this invention can be performed in retail stores, squad cars and similar non-laboratory settings.

It should further be apparent in those skilled in the art that various changes in form and detail of the invention as described above may be made. It is intended that such changes be included within the spirit and scope of the claims appended hereto.

What is claimed is:

1. A process for identifying an article, which comprises:

(a) applying a finely divided inorganic phosphor to said article,
(b) exciting said phosphor to store energy therein by means of light free of infrared wavelengths,
(c) observing any spontaneous decay phosphorescence of said phosphor in a darkened ambient,
(d) stimulating said phosphor with infrared radiation, said stimulating producing an observable change in release of the previously stored energy,
(e) observing the change in release of the previously stored energy as a change in luminescence of said phosphor as a result of said infrared stimulation.

2. The process of claim 1 additionally comprising the steps of:

(f) stimulating said phosphor thermally, and (
(g) observing a change in luminescence of said phosphor as a result of said thermal stimulation.

3. The process of claim 2 additionally comprising the steps of:

(h) stimulating said phosphor with an electric field, and
(i) observing a change in luminescene of said phosphor as a result of said electric field stimulation.

4. The process of claim 1 additionally comprising the steps of:

(f) stimulating said phosphor with an electric field, and
(g) observing a change in luminescence of said phosphor as a result of said electric field stimulation.

5. The process of claims 1, 2, 3 or 4 in which said phosphor is a mixed phosphor.

6. The process of claim 5 in which said mixed phosphor is an intermediate converter.

7. The process of claim 6 in which the change in stimulated luminescence of said phosphor is a relatively time independent substantial increase in emission of light by said phosphor.

8. The process of claim 5 in which component ratios in said mixed phosphor are varied to achieve luminescence spectra shifts to different wavelengths to increase the number of usable phosphors exhibiting unique behavior for identification purposes.

9. A process for identifying an article, which comprises:

(a) applying a stimulatable inorganic phosphor to said article,
(b) exciting said phosphor to store energy therein,
(c) stimulating said phosphor in a manner different than said exciting, said stimulating producing an observable change in emission as radiant energy of the energy stored by said exciting, and (d) observing the change in emission of radiant energy from said phosphor as a result of said stimulating to verify the presence of the inorganic phosphor in said article.

10. The process of claim 9 in which the change in emission as a result of said stimulating is luminescence of said phosphor.

11. The process of claim 9 in which said phosphor is excited with ultraviolet or visible light, stimulated with visible or infrared light, thermal conduction, or an electric field, and the change in emission of said phosphor as a result of said stimulating is luminescence of visible light.

12. The process of claim 9 in which said phosphor is stimulated with radiant energy and additionally comprising the steps of:

(f) stimulating said phosphor thermally, and (g) observing a change in luminescence of said phosphor as a result of said thermal stimulation.

13. The process of claim 12 additionally comprising the steps of:

(h) stimulating said phosphor with an electric field, and (i) observing a change in luminescence of said phosphor as a result of said electric field stimulation.

14. The process of claim 9 in which said phosphor is stimulated with radiant energy and additionally comprising the steps of:

(f) stimulating said phosphor with an electric field, and (g) observing a change in luminescence of said phosphor as a result of said electric field stimulation.

15. The process of claims 9, 12, 13 or 14 in which said phosphor is a mixed phosphor.

16. The process of claim 15 in which said mixed phosphor is an intermediate converter.

17. The process of claim 16 in which the change in stimulated luminescence of said phosphor is a relatively time independent substantial increase in emission of light by said phosphor.

18. The process of claim 15 in which component ratios in said mixed phosphor are varied to achieve luminescence spectra shifts to different wavelengths to increase the number of usable phosphors exhibiting unique behavior for identification purposes.

19. An article of verifiable authenticity, comprising said article and a stimulatable inorganic phosphor applied to said article, excitation in a first manner and subsequent stimulation in a second manner different than the first manner of said phosphor providing a unique indicator of the presence of said phosphor.

20. The article of claim 19 in which said phosphor is a mixed phosphor.

21. The article of claim 20 in which said mixed phosphor is an intermediate converter.

22. The article of claim 21 in which the change in stimulated luminescence of said phosphor is a relatively time independent substantial increase in emission of light by said phosphor.

23. The article of claim 19 in which component ratios in said mixed phosphor are varied to achieve luminescence spectra shifts to different wavelengths to increase the number of usable phosphors exhibiting unique behavior for identification purposes.

24. The process of claims 1 or 9 in which said phosphor is applied in an identifying code pattern which identifies a channel of distribution for the article.

25. The article of claim 19 in which said phosphor is applied in an identifying code pattern which identifies a channel of distribution for the article.

* * * * *